United States Patent [19]

Tringali

[11] 4,372,062

[45] Feb. 8, 1983

[54] SKI BOOT

[75] Inventor: Robert D. Tringali, New York, N.Y.

[73] Assignee: Joel H. Eisenberg, Stratford, Conn.

[21] Appl. No.: 220,778

[22] Filed: Dec. 29, 1980

[51] Int. Cl.[3] ..... A43B 5/04
[52] U.S. Cl. ..... 36/120
[58] Field of Search ..... 36/117, 118, 119, 120, 36/121

[56] References Cited

U.S. PATENT DOCUMENTS

| | | | |
|---|---|---|---|
| 4,074,446 | 2/1978 | Eisenberg | 36/120 |
| 4,144,659 | 3/1979 | Eisenberg | 36/120 |
| 4,253,252 | 3/1981 | Eisenberg | 36/120 |

*Primary Examiner*—Patrick D. Lawson

[57] ABSTRACT

A ski boot comprising an outer boot having a sole, a plate disposed on the sole inside the boot, the plate adapted to receive the skier's foot and to transmit forward pressure of the foot, plantar-flexion caused by the tibio-talar joint, to the edge of an attached ski for turning.

27 Claims, 9 Drawing Figures

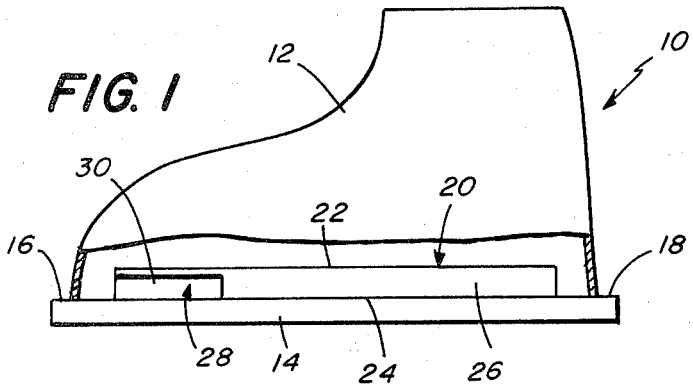
FIG. 1
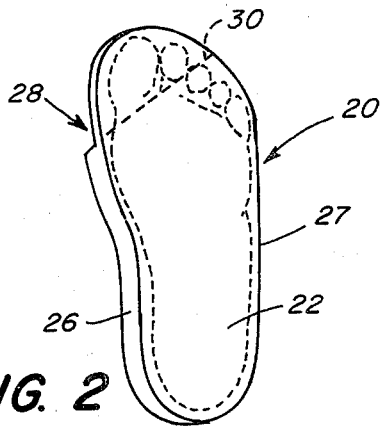
FIG. 2
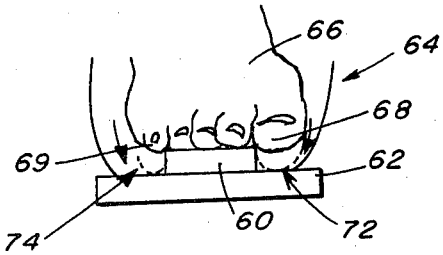
FIG. 5
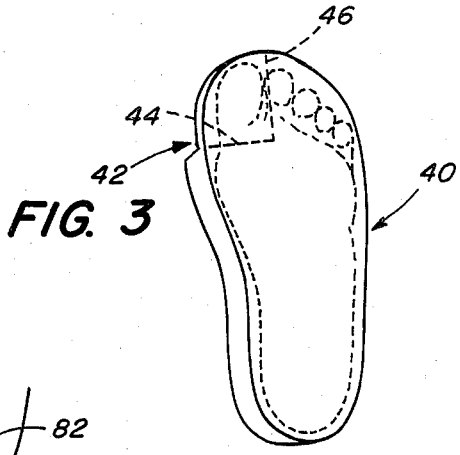
FIG. 3
FIG. 6
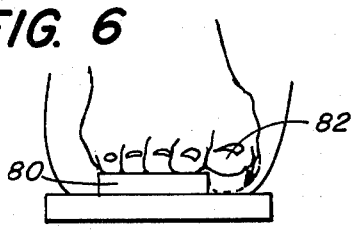
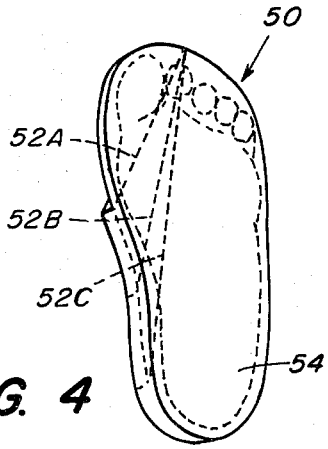
FIG. 4
FIG. 7A
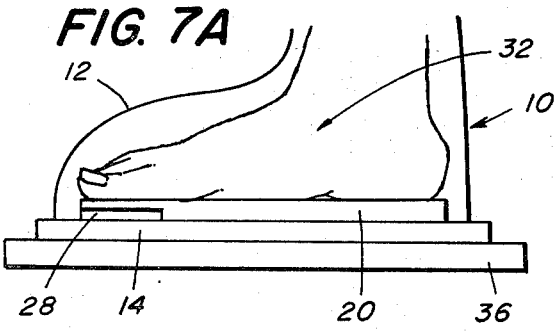
FIG. 7B
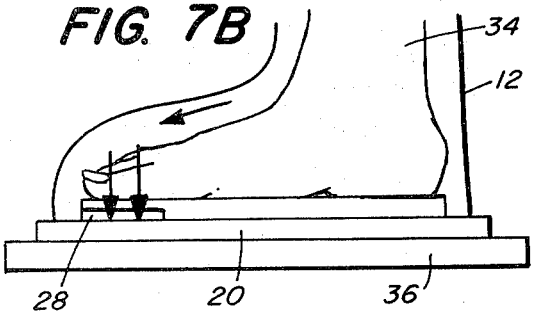
FIG. 7C
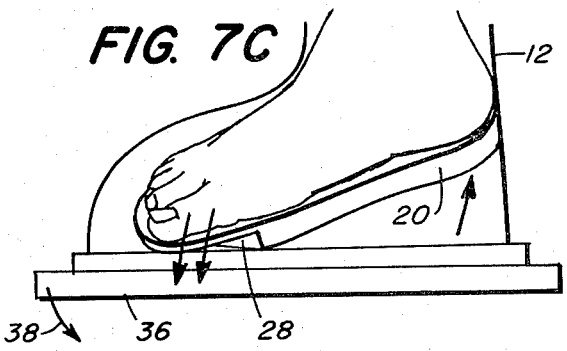

SKI BOOT

FIELD OF THE INVENTION

This invention relates to an improvement in ski boots, particularly in regard to the manner in which the ski boot functions with respect to the foot of the skier in turning or maneuvering.

BACKGROUND OF THE INVENTION

In the prior art, ski boots immobilized the foot and ankle of the skier, and the skier turned by swinging his knees and torso so that weight was applied over the edge of the skis in the direction of the turn. The background relating to these prior art boots and the drawbacks pertaining thereto are fully set forth in Eisenberg U.S. Pat. Nos. 4,074,446 and 4,144,659.

The above-identified patents disclose a means for turning by using the natural lateral tilting motion of the foot called inversion and eversion. This lateral tilting is a function of the sub talar joint of the ankle and foot, and by using this motion to tilt the ski boot-mounted insert of these inventions, the skier's weight can be transmitted to the edge of the ski without the need for swinging the knees and twisting the torso. Some skiers, however, because of tarsal coalitions, triple anthrodesis, calcaneal or talar fractures, inadequate peroneal musculature or other factors do not have the requisite sub talar motion and, therefore, are unable to invert or evert the foot as required.

SUMMARY OF THE INVENTION

I have discovered that a skier can apply weight to the selected edges of his skis, and thus turn, by merely applying forward pressure to the area under the front of the foot, i.e., anterior progression plane, and providing a means for directing and concentrating this resulting forward pressure onto the edge of the attached ski.

In the preferred embodiment, a foot support plate, having the portion beneath the large toe of the skier's foot cut away, is placed inside a ski boot. In order to turn, the skier uses the strong gastroc-soleus complex of muscles and the tibio-talar joint to lean the outboard foot forwardly and thereby apply pressure in the anterior progression plane to the plate. Because the portion of the plate underneath the large toe is cut away, this forward pressure essentially becomes concentrated as a downward pressure under the big toe area (antero-medial area). This antero-medial pressure is essentially over the inboard edge of the outboard ski thereby effectively weighting that edge, and the ski turns in the direction of the weighted edge. Or, more simply, the skier allows gravity to flex the ankle by bending forward at the knees. This transmits pressure to the inboard edge of the ski, weighting that edge and thereby turning the ski. It also takes advantage of normal operation of the knee, when weight-bearing, in that the leg has a helicoid or spiral action, and there is a synchrony of flexion with medial rotation further assisting the turning of the ski. In short, the structure of the leg is such that flexing the knee naturally causes the foot to turn inwardly thereby aiding the inward turn.

In another embodiment, the plate is secured to the inside sole of the boot, and in order to turn the antero-medial portion of the skier's foot falls off the plate into a cut-out area in the plate.

In another embodiment, the heel portion of the skier is secured in the boot thereby preventing the skier's foot from rising out of the boot, while the front portion of the foot remains free to apply the forward anterior-progression pressure necessary to turn.

This invention allows the skier to turn and maneuver by simply leaning forward to apply a forward pressure from the front of the foot to the ski.

DRAWINGS

We turn now to the structure and operation of a preferred embodiment, after first briefly describing the drawings.

FIG. 1 is a side view of the ski boot according to the invention herein with the lower portion broken away;

FIG. 2 is a top view of a foot supporting plate of the preferred embodiment;

FIG. 3 is a top view of another foot supporting plate of this invention;

FIG. 4 is a perspective view of another foot supporting plate of this invention;

FIG. 5 is a cut-away front view of another foot supporting plate of this invention;

FIG. 6 is a cut-away front view of another foot supporting plate of this invention; and FIGS. 7A, 7B and 7C are sequential steps of the plate of the preferred embodiment in operation.

DESCRIPTION OF THE PREFERRED EMBODIMENT

A ski boot 10 according to the invention is shown in FIG. 1. The ski boot 10 generally comprises an outer shell 12 of high impact plastic and an integral sole 14 with front and rear extensions 16, 18, which extensions are adapted to be received by the ski bindings (not shown).

As best shown in FIG. 2, a foot supporting plate 20 is placed inside the boot 10, and it rests on the sole 14. Plate 20 is generally flat having a top surface 22 and a bottom surface 24 separated by an inboard sidewall 26. It can, however, be contoured to the foot or adapted to receive another portion (not shown) which is contoured to the foot. An opening 28 is disposed beneath the portion of top surface 22 which would support the big toe of the skier's foot (shown dotted in FIG. 2) when it is in place on the plate 20. The opening 28 is bounded by a diagonal sidewall 30 which extends at an approximate 45° angle from the front of the plate to the front end of the inboard sidewall 26, which end is immediately behind the area for the big toe.

OPERATION

The plate 20 is placed inside the ski boot 10, as shown in FIG. 1. Plate 20 is not fastened to the boot 10, although the plate 20 fits snugly enough therein so that it will not slide on its bottom surface 24 when the skier's foot is in place.

The skier then places his foot in the boot 10, and the foot rests upon the top surface 22 of the plate 20 with the large toe of the foot above the opening 28. The skier may wear an insulated inner boot (not shown) for warmth. If so, the sole of the flexible inner boot rests on top surface 22 of the plate 20.

In order to turn, the skier must apply weight to the edge of his skis. More specifically, if the skier wants to turn left, he presses downwardly on the inboard or left edge of his right ski. The left ski, which is not actively weighted or unweighted, more or less follows the resulting left turn caused by the weighting of the right ski.

For a right turn, the inboard or right edge of the left ski is weighted, and the right ski follows the resulting turn.

In order to make a left turn with this invention, the skier merely uses the gastroc-soleus complex of muscles and the tibio-talar joint to move the foot in the forward plane of progression, i.e., to lean the right foot forwardly as if stepping on the ball of the foot (pressure on the anterior progression plane). Due to the configuration of the plate 20 with its opening 28, this forward pressure is automatically brought under the antero-medial area of the foot, the big toe region, as the plate gives way along the diagonal sidewall 30. The plate 20 tilts slightly along this diagonal axis. The resulting pressure is essentially over the inboard edge of the right ski, and the ski turns in the inboard direction, the left. The flexion of the ankle associated with the natural flexion of the knee utilizes the knee's condylar-cruciate menisci complex for a synchronous medial rotation thereby further augmenting the turn with minimal expenditure of energy. In short, in addition to the weighting of the ski edge as described above, flexing the right knee turns the right foot and, of course, the attached ski, inwardly. This contributes to the turn, and thereby reduces the energy required to turn. At the same time as this sequence is occurring, the skier's other foot, his left, is essentially in a relaxed state, and generally applying weight evenly to its attached ski. The sequence is the same for a right turn except that the left foot controls the turn.

The sequence of these foot movements is shown in FIG. 7. In FIG. 7A, the right foot 32 is shown flat on the plate 20. In FIG. 7B, the skier has used his strong gastroc-soleus muscle complex located generally at 34 to begin applying forward pressure on the plate 20 or merely allows gravity to flex the right knee and ankle. In FIG. 7C, the forward pressure is transmitted to the antero-medial area and the inboard or left edge of ski 36 and the ski begins its turn to the left as indicated by the arrow 38.

The skier, therefore, can perform a turn by using this forward foot lean caused by the operation of a very strong muscle group, the gastroc-soleus complex and the tibio-talar joint or by allowing gravity to forward bend the knee and ankle. Because of the forward position of the diagonal sidewall 30, the foot does not laterally tilt, i.e., invert or evert, and does not use the sub talar joint or the associated muscle complex, the peroneii, to cause the ski to turn. An individual without ankle or subtalar function could ski in this invention by pressure applied through intertarsal, metatarsal and phalangeal components, together or separately.

OTHER EMBODIMENTS

Referring to FIG. 3, another foot supporting plate 40 is shown. Plate 40 is similar to plate 20 except that under the antero-medial area there are two intersecting sidewalls 44, 46 which combine to form an opening 42 with a quarter circle cross-section. The operation of the plate 40 is the same as discussed above.

Referring to FIG. 4, a foot supporting plate 50 of this invention may have its diagonal sidewall cut at any number of other positions, as shown by a few representative sidewalls indicated by the dashed lines 52A, 52B and 52C. The plate 50, however, will tilt more easily as the diagonal sidewall extends farther towards the heel 54 of the plate 50, and the farther the sidewall extends toward the heel, the greater the likelihood that some lateral tilting, inversion or eversion, of the foot may occur. Of course, with this embodiment, it is also possible to construct the plate so that it is stepped with several diagonals. This would permit the skier to automatically apply pressure in steps for a gradual turn, a tight turn and a very sharp turn.

Another embodiment of the invention is shown in FIG. 5. There, a plate 60 is connected to the center portion of an inside sole 62 of a ski boot 64. The plate 60 may be integral with the sole 62. The plate 60 is not as wide as the skier's foot 66. Instead, when the foot 66 is in place in a flat position, the large toe 68 and the little toe 69 overhang the plate 60. In operation, when the skier wishes to turn, he applies forward pressure on the foot 66 and the large toe 68 drops off into open area 72 (as indicated by the dashed lines) thereby applying pressure to this edge of the attached ski (not shown). Similarly, the little toe 69 may also be used to drop off into open area 74 (as indicated by the arrow) to apply weight to the other edge.

Another plate 80 is shown in FIG. 6. There, the plate 80 is identical to the plate of FIG. 5 except that it is wider so that only a big toe 82 overhangs the plate 80. The operation of the plate is as explained above.

Finally, in any of the above embodiments, it is possible to secure the heel of the skier's foot inside the boot. This effectively separates the lateral and rotary motion of the body from the motion required to turn the skis. It also prevents the skier's foot from rising out of the boot as the skier goes over bumps. By turning through forward pressurization, one can secure the foot against inversion, eversion and any lateral motion, which would give the skier a feeling of instability. Further, by limiting the foot's inversion, body torque can more immediately be transmitted to the foot and ski for turning.

Other variations will be apparent to those skilled in the art.

What I claim is:

1. A ski boot comprising:

an outer boot, and an insert, said insert supporting the foot of a skier and having means for transmitting forward pressure exerted by the foot in the anterior progression plane into pressure on the antero-medial region thereby weighting the inboard edge of a ski attached to said boot.

2. The ski boot of claim 1 wherein said insert comprises a plate and said means for transmitting comprises a diagonally-aligned forward wall whereby the forward pressure causes said plate to tilt along said forward wall.

3. The ski boot of claim 2 wherein said wall extends from the front of said plate under the portion of said plate adapted to receive the big toe of a skier.

4. The ski boot of claim 3 wherein said wall begins at the approximate mid-point of the front of said plate and ends on the inboard side of said plate immediately behind the antero-medial region.

5. The ski boot of claim 4 wherein except for a thin top portion of said plate, an area forward of said wall is cut away.

6. The ski boot of claim 1 wherein said insert comprises a plate, and said means for transmitting comprises a first wall and a second wall, said walls meeting beneath the antero-medial region of said plate whereby forward pressure by the foot in the anterior progression plane of said plate causes said plate to tilt along a diagonal axis between the non-adjacent ends of said first and second walls.

7. The ski boot of claim 2 wherein said wall extends from the front of said plate to the approximate mid-point of the inboard side of said plate.

8. The ski boot of claim 2 wherein said wall extends from the front of said plate to a point on the inboard side of said plate forward of a heel area.

9. The ski boot of claims 7 or 8 wherein said wall begins at a point to the outboard of the midpoint of the front of said plate.

10. The ski boot of claim 1 wherein said means for transmitting comprises a portion of a plate, said plate longitudinally disposed in the bottom of said boot and said portion having an open area on the inboard side beneath the antero-medial region.

11. The ski boot of claim 10 wherein said plate is fixed to the bottom of said boot.

12. The ski boot of claim 10 wherein said plate is rectangular.

13. The ski boot of claim 10 wherein said open area extends the inboard length of said plate.

14. The ski boot of claim 10 wherein said plate has an open area on the outboard side beneath the little toe region.

15. An insert for use with a ski boot, said insert having a means for transmitting forward pressure by the foot of a skier in the anterior progression plane into pressure on the antero-medial region and a lateral edge of said insert.

16. The insert of claim 15 wherein said insert comprises a plate, and said means for transmitting comprises a diagonally-aligned forward wall whereby the forward pressure causes said plate to tilt along said forward wall.

17. The insert of claim 16 wherein said wall extends from the front of said plate under the portion of said plate adapted to receive the big toe of a skier.

18. The insert of claim 17 wherein said wall begins at the approximate mid-point of the front of said plate and ends on a side of said plate immediately behind the antero-medial region.

19. The insert of claim 18 wherein except for a thin top portion of said plate, an area forward of said wall is cutaway.

20. The insert of claim 15 wherein said insert comprises a plate, said plate having a first wall and a second wall, said walls meeting beneath the antero-medial region of said plate whereby forward pressure on the plate in the anterior progression plane causes said plate to tilt along diagonal axis between the non-adjacent end of said first and second walls.

21. The insert of claim 16 wherein said wall extends from the front of said plate to the approximate mid-point of a side of said plate.

22. The insert of claim 16 wherein said wall extends from the front of said plate to a point on a side of said plate forward of a heel area.

23. The insert of claims 21 or 22 wherein said wall begins at a point on the front of said plate between its mid-point and the opposite side of said plate.

24. The insert of claim 15 wherein said means for transmitting comprises a portion of a plate, said portion having an open area in the antero-medial region.

25. The insert of claim 24 wherein said plate is rectangular.

26. The insert of claim 24 wherein said one open area extends the length of said plate.

27. The insert of claim 24 wherein said plate has an open area in the little toe region.

* * * * *